US006210857B1

(12) United States Patent
Vermeersch et al.

(10) Patent No.: US 6,210,857 B1
(45) **Date of Patent: *Apr. 3, 2001**

(54) HEAT SENSITIVE IMAGING ELEMENT FOR PROVIDING A LITHOGRAPHIC PRINTING PLATE

(75) Inventors: Joan Vermeersch, Deinze; Dirk Kokkelenberg, St. Niklaas; Marc Van Damme, Heverlee, all of (BE)

(73) Assignee: Agfa-Gevaert

( * ) Notice: Subject to any disclaimer, the term of this patent is extended or adjusted under 35 U.S.C. 154(b) by 0 days.

This patent is subject to a terminal disclaimer.

(21) Appl. No.: 09/309,288

(22) Filed: May 11, 1999

Related U.S. Application Data

(60) Provisional application No. 60/095,477, filed on Aug. 5, 1998.

(30) Foreign Application Priority Data

Jun. 26, 1998 (EP) ..... 98202152

(51) Int. Cl.[7] ..... G03C 1/76

(52) U.S. Cl. ..... 430/270.1; 430/272.1; 430/302

(58) Field of Search ..... 430/270.1, 302, 430/303, 944, 945, 271.1, 272.1

(56) References Cited

U.S. PATENT DOCUMENTS 5,816,162 * 10/1998 Vermeersch ..... 101/467

FOREIGN PATENT DOCUMENTS

| | | |
|---|---|---|
| 0 573 092 | 12/1993 | (EP) . |
| 0 619 524 | 10/1994 | (EP) . |
| 0 619 525 | 10/1994 | (EP) . |
| 0 620 502 | 10/1994 | (EP) . |
| WO 94/18005 | 8/1994 | (WO) . |

* cited by examiner

*Primary Examiner*—Hoa Van Le
*Assistant Examiner*—Barbara Gilmore
(74) *Attorney, Agent, or Firm*—Breiner & Breiner

(57) ABSTRACT

According to the present invention there is provided a heat-sensitive imaging element for providing a lithographic printing late, comprising a lithographic base with a hydrophobic oleophilic surface and a top layer comprising a compound capable of converting light into heat and a hydrophilic polymer, characterized in that said hydrophilic polymer is crosslinked.

10 Claims, No Drawings

HEAT SENSITIVE IMAGING ELEMENT FOR PROVIDING A LITHOGRAPHIC PRINTING PLATE

The application claims the benefit of U.S. Provisional Application No. 60/095,477 filed Aug. 5, 1998

FIELD OF THE INVENTION

The present invention relates to a heat sensitive imaging element. More specifically the invention is related to a heat sensitive imaging imaging element for preparing a lithographic printing plate which can be imaged by rub-off or on the press.

BACKGROUND OF THE INVENTION

Lithography is the process of printing from specially prepared surfaces, some areas of which are capable of accepting lithographic ink, whereas other areas, when moistened with water, will not accept the ink. The areas which accept ink define the printing image areas and the ink-rejecting areas define the background areas.

In the art of photolithography, a photographic material is made imagewise receptive to oily or greasy inks in the photo-exposed (negative-working) or in the non-exposed areas (positive-working) on a hydrophilic background.

In the production of common lithographic printing plates, also called surface litho plates or planographic printing plates, a support that has affinity to water or obtains such affinity by chemical treatment is coated with a thin layer of a photosensitive composition. Coatings for that purpose include light-sensitive polymer layers containing diazo compounds, dichromate-sensitized hydrophilic colloids and a large variety of synthetic photopolymers. Particularly diazo-sensitized systems are widely used.

Upon imagewise exposure of the light-sensitive layer the exposed image areas become insoluble and the unexposed areas remain soluble. The plate is then developed with a suitable liquid to remove the diazonium salt or diazo resin in the unexposed areas.

Alternatively, printing plates are known that include a photosensitive coating that upon image-wise exposure is rendered soluble at the exposed areas. Subsequent development then removes the exposed areas. A typical example of such photosensitive coating is a quinone-diazide based coating. they show a lower dot crispness. The trend towards heat mode printing plate precursors is clearly seen on the market.

EP-A-444 786, JP-63-208036,and JP-63-274592 disclose photopolymer resists that are sensitized to the near IR. So far, none has proved commercially viable and all require wet development to wash off the unexposed regions. EP-A-514 145 describes a laser addressed plate in which heat generated by the laser exposure causes particles in the plate coating to melt and coalescence and hence change their solubility characteristics. Once again, wet development is required.

EP-A-580 393 disclose a lithographic printing plate directly imageable by laser discharge, the plate comprising: (a) a topmost first layer; and (b) a second layer underlying the first layer; wherein the first layer is characterized by efficient absorption of infrared radiation; and (d) the first and second layer exhibit different affinities for at least one printing liquid selected from the group consisting of ink and an abhesive fluid for ink. According to this invention printing plates for wet offset and printing plates for waterless offset can be prepared. However the plates for wet offset have a poor endurance.

WO 94/18005 discloses a heat mode recording material having a high recording speed comprising on a support having an ink receptive surfaceor being coated with an ink receptive layer a substance capable of converting light into heat and a hardened hydrophilic surface layer having a thickness not more than 3 $\mu$m. The substance capable of converting light into heat is present in the support or in a separate recording layer. This is detrimental for a high sharpness of the image due to lateral diffusion of the heat and the light diffraction.

OBJECTS OF THE INVENTION

It is an object of the invention to provide an ablative imaging element for preparing a lithographic printing plate which is negative working.

It is also an object of the invention to provide an ablative imaging element for preparing a lithographic printing plate which Typically, the above described photographic materials from which the printing plates are made are exposed in contact through a photographic film that contains the image that is to be reproduced in a lithographic printing process. Such method of working is cumbersome and labor intensive. However, on the other hand, the printing plates thus obtained are of superior lithographic quality.

Attempts have thus been made to eliminate the need for a photographic film in the above process and in particular to obtain a printing plate directly from computer data representing the image to be reproduced. However the above mentioned photosensitive coatings are not sensitive enough to be directly exposed to a laser. Therefor it has been proposed to coat a silver halide layer on top of the photosensitive coating. The silver halide can then directly be exposed by means of a laser under the control of a computer. Subsequently, the silver halide layer is developed leaving a silver image on top of the photosensitive coating. That silver image then serves as a mask in an overall exposure of the photosensitive coating. After the overall exposure the silver image is removed and the photosensitive coating is developed. Such method is disclosed in for example JP-A-60-61 752 but has the disadvantage that a complex development and associated developing liquids are needed.

GB-1 492 070 discloses a method wherein a metal layer or a layer containing carbon black is provided on a photosensitive coating. This metal layer is then ablated by means of a laser so that an image mask on the photosensitive layer is obtained. The photosensitive layer is then overall exposed by UV-light through the image mask. After removal of the image mask, the photosensitive layer is developed to obtain a printing plate. This method however still has the disadvantage that the image mask has to be removed prior to development of the photosensitive layer by a cumbersome processing.

Furthermore methods are known for making printing plates involving the use of imaging elements that are heat-sensitive rather than photosensitive. A particular disadvantage of photosensitive imaging elements such as described above for making a printing plate is that they have to be shielded from the light. Furthermore they have a problem of sensitivity in view of the storage stability and shows a good ink-uptake in the exposed areas and no scumming in the non-exposed areas.

It is also an object of the invention to provide an ablative imaging element for preparing a lithographic printing plate which shows a good printing endurance.

It is also an object of the invention to provide an ablative imaging element for preparing a lithographic printing plate which can be exposed and developed on the printing press.

It is also an object of the invention to provide an ablative imaging element for preparing a lithographic plate with a high sharpness.

Further objects of the invention will become clear from the description hereafter.

SUMMARY OF THE INVENTION

According to the present invention there is provided a heat-sensitive imaging element for providing a lithographic printing plate, comprising a lithographic base with a hydrophobic oleophilic surface and a top layer layer comprising a compound capable of converting light into heat and a hydrophilic polymer, characterized in that said hydrophilic polymer is crosslinked.

DETAILED DESCRIPTION OF THE INVENTION

According to the invention the lithographic base comprises a hydrophobic oleophilic surface. Preferred bases are plastic films such as polyethylene film, polypropylene film, polyvinylchloride film, polycarbonate film, polystyrene film, polyethylene terephthalate film and polyethylene naphthalate film. The plastic film support may be opaque or transparent It is particularly preferred to use a polyester film support to which an adhesion improving layer has been provided. Particularly suitable adhesion improving layers for use in accordance with the present invention comprise a hydrophilic binder and colloidal silica as disclosed in EP-A-619 524, EP-A-620 502 and EP-A-619 525. Preferably, the amount of silica in the adhesion improving layer is between 200 mg per $m^2$ and 750 mg per $m^2$. Further, the ratio of silica to hydrophilic binder is preferably more than 1 and the surface area of the colloidal silica is preferably at least 300 $m^2$ per gram, more preferably at least 500 $m^2$ per gram.

An aluminum support and a paper support can also be used when they are covered with a hydrophobic oleophilic layer such as the polymers mentioned above. The lithographic base has preferably a thickness between 0.13 and 0.50 mm.

The top layer layer comprises a compound capable of converting light into heat and a crosslinked hydrophilic polymer. Suitable compounds capable of converting light into heat are preferably infrared absorbing components although the wavelength of absorption is not of particular importance as long as the absorption of the compound used is in the wavelength range of the light source used for image-wise exposure. Particularly useful compounds are for example dyes and in particular infrared absorbing dyes and pigments and in particular infrared absorbing pigments. Examples of infrared absorbing dyes are disclosed in EP-A-97 203 131.4. Preferred dyes are cyanine dyes, more preferably cyanine dyes with at least two sulphonic acid groups, most preferably cyanine dyes with at least two sulphonic acid groups and two indolenine groups. Particularly preferred are the following two structures:

IR-1

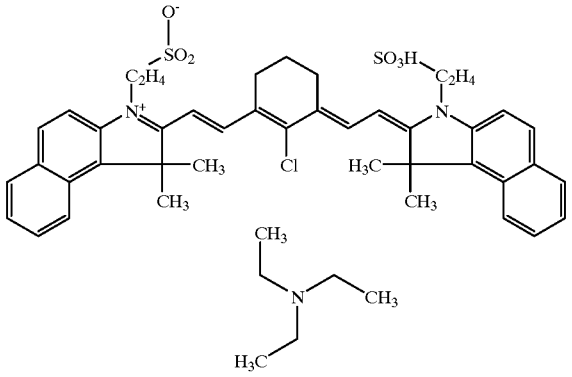

IR-2

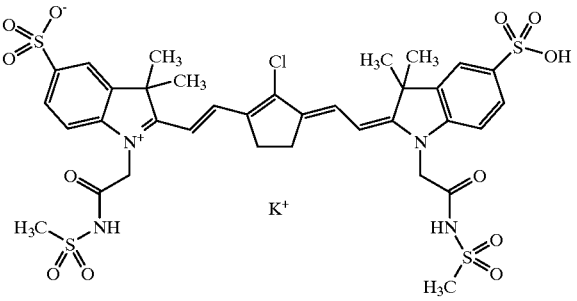

Examples of infrared absorbing pigments are carbon black, metal carbides, borides, nitrides, carbonitrides, bronze-structured oxides and oxides structurally related to the bronze family but lacking the A component e.g. $WO_{2.9}$. It is also possible to use conductive polymer dispersion such as polypyrrole or polyaniline-based conductive polymer dispersions.

Said compound capable of converting light into heat is present in the imaging element preferably in an amount between 1 and 25% by weight of the total weight of the image forming layer, more preferably in an amount between 2 and 20% by weight of the total weight of the image forming layer. The compound capable of converting light into heat is most preferably present in the imaging element in an amount to provide an optical density at a wavelength between 800 nm and 1100 nm of at least 0.35.

A particularly suitable crosslinked hydrophilic layer may be obtained from a hydrophilic binder cross-linked with a cross-linking agent such as formaldehyde, glyoxal, polyisocyanate or a hydrolysed tetra-alkylorthosilicate. The latter is particularly preferred.

As hydrophilic binder there may be used hydrophilic (co)polymers such as for example, homopolymers and copolymers of vinyl alcohol, acrylamide, methylol acrylamide, methylol methacrylamide, acrylate acid, methacrylate acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60 percent by weight, preferably 80 percent by weight.

The amount of crosslinking agent, in particular of tetraalkyl orthosilicate, is preferably at least 0.2 parts by weight per part by weight of hydrophilic binder, more preferably between 0.5 and 5 parts by weight, most preferably between 1.0 parts by weight and 3 parts by weight.

A cross-linked hydrophilic layer used in accordance with the present embodiment preferably also contains substances that increase the mechanical strength and the porosity of the layer. For this purpose colloidal silica may be used. The colloidal silica employed may be in the form of any commercially available water-dispersion of colloidal silica for example having an average particle size up to 40 nm, e.g. 20 nm. The amount of colloidal silica lies preferably between 0.05 and 10 parts by weight versus the amount of hydrophilic binder. In addition inert particles of larger size than the colloidal silica may be added e.g. silica prepared according to Stober as described in J. Colloid and Interface Sci., Vol. 26, 1968, pages 62 to 69 or alumina particles or particles having an average diameter of at least 100 nm which are particles of titanium dioxide or other heavy metal oxides. By incorporating these particles the surface of the cross-linked hydrophilic layer is given a uniform rough texture consisting of microscopic hills and valleys, which serve as storage places for water in background areas.

The crosslinked hydrophilic polymer yields a top layer which is insoluble in water or in an aqueous fountain solution.

The image forming layer is preferably applied in a thickness between 0.25 and 5 $\mu$m, more preferably in a thickness between 0.5 and 3 $\mu$m.

Between the top layer and the hydrophobic oleophilic surface of the support there can be present at least one additional layer. Said layer comprises at least one compound selected from the group of hydrophilic binders, silica and polymer latices. The hydrophilic binder is preferably a hydrophilic colloid, usually a protein, preferably gelatin. Gelatin can, however, be replaced in part or integrally by synthetic, semi-synthetic, or natural polymers.

Said silica is a colloidal silica with a mean number diameter between 0.01 and 1 $\mu$m.

A latex is defined as a stable colloidal dispersion of a polymeric substance in an aqueous medium. The polymer particles are usually approximately spherical and of typical colloidal dimensions: particle diameters range from about 20 to 1000 nm. The dispersion medium is usually a dilute aqueous solution containing substances such as electrolytes, surfactants, hydrophilic polymers and initiator residues. The polymer latices are classified in various way. By origin, they are classified as natural latices, produced by metabolic processes occuring in the cells of certain plant species; synthetic latices, produced by emulsion polymerization of monomers; and artificial latices, produced by dispersing a polymer in a dispersing medium.

Preferred latices in connection with the invention are synthetic and artificial latices. These artificial latices are rather referred to as polymer dispersions. These polymers or oligomeric species could be dispersed in water either before their polymerization and/or crosslinking or afterwards. The colloidal stability of the dispersion can be improved by the addition of dispersion agents (surface-active compounds) or by ionic groups incorporated via the monomeric species or via modification. The dispersions of the polymers (or oligomers) can contain crosslinking agents, polymerization catalyst, or incorporated species which can give self-crosslinking of the polymer, to obtain sufficient mechanical strength A hydrophobic polymer for use in a latex according to the present invention has preferably a Tg of at least 30° C., more preferably a Tg of at least 35° C.

The hydrophobic polymer latex for use in the present invention may contain conventional emulsifiers.

Hydrophobic polymers for use in synthetic latices according to the present invention are, for example, polystyrene, polyacrylates such as polymethyl methacrylate and polybutyl acrylate, copolymers of butyl acrylate and methyl methacrylate, copolymers of butyl acrylate and styrene, homopolymers of butadiene, copolymers of butadiene and methyl methacrylate. Hydrophobic polymers for use in artificial latices according to the present invention are, for example polyurethanes such as the condensation product of polyester and isoforon diisocyanate.

Imaging in connection with the present invention is preferably done with an image-wise scanning exposure, involving the use of a laser, more preferably of a laser that operates in the infrared or near-infrared, i.e. wavelength range of 700–1500 nm. Most preferred are laser diodes emitting in the near-infrared. Exposure of the imaging element can be performed with lasers with a short as well as with lasers with a long pixel dwell time. Preferred are lasers with a pixel dwell time between 0.005 $\mu$s and 20 $\mu$s.

In another embodiment of the invention the exposure of the imaging element can be carried out with the imaging element already on the press. A computer or other information source supplies graphics and textual information to the laser via a lead.

The printing plate of the present invention can also be used in the printing process as a seamless sleeve printing plate. This cylindrical printing plate has such a diameter that it can be slided on the print cylinder. More details on sleeves are given in "Grafisch Nieuws" ed. Keesing, 15, 1995, page 4 to 6.

Subsequent to image-wise exposure, the image-wise exposed imaging element can be developed by a dry rub-off or by a wet rub-off using water or an aqueous solution.

More preferably the image-wise exposed imaging element after optional wiping is mounted on a print cylinder of a printing press with the backside of the imaging element (side of the support opposite to the side having the photosensitive layer). According to a preferred embodiment, the printing press is then started and while the print cylinder with the imaging element mounted thereon rotates, the dampener rollers that supply dampening liquid are dropped on the imaging element and subsequent thereto the ink rollers are dropped. Generally, after about 10 revolutions of the print cylinder the first clear and useful prints are obtained. According to an alternative method, the ink rollers and dampener rollers may be dropped simultaneously or the ink rollers may be dropped first.

An exposed imaging element in accordance with the present invention is preferably mounted on a printing press and used to print shortly after the exposure. It is however possible to store an exposed imaging element for some time before using it on a printing press to print copies.

Suitable dampening liquids that can be used in connection with the present invention are aqueous liquids generally having an acidic pH and comprising an alcohol such as isopropanol and silica. With regard to dampening liquids useful in the present invention, there is no particular limitation and commercially available dampening liquids, also known as fountain solutions, can be used.

The invention will now be illustrated by the following examples without however the intention to limit the invention thereto. All parts are by weight unless stated otherwise.

EXAMPLE 1

Preparation of the ablative hydrophilic layer.

To a polyethylene coated paper support, coated with a primer containing a latex of copoly(vinylidenechloride/methylmethacrylate/itaconic acid) and silica and coated with a second subbing layer containing gelatin and silica, following coating solution was coated at a wet coverage of 30 g/m$^2$, dried at 40° C. and subsequently hardened by subjecting it to a temperature of 67° C. at 50% RH for 12 hrs.

Coating solution.

To 50 g of a dispersion containing 30% KIESELSOL 300F™ (trade name of Bayer for a silica) were subsequently added, while stirring, 138 g of deionized water, 540 g of a 1% solution of an IR-absorber (as described in table 1) 108 g of a 5% solution of a hydrophilic binder (as described in table 1) and 152 g of a hydrolyzed 22% tetramethyl orthosilicate emulsion in water. The pH was adjusted to pH=4. Tho this mixture was then added 12 g of a mixture of two wetting agents.

TABLE 1

| Example | Hydrophilic binder | IR-absorber |
|---|---|---|
| 1 | CARBOPOL 801 ™ | IR-1 |
| 2 | CARBOPOL 801 ™ | IR-2 |
| 3 | CARBOPOL 801 ™ | PRINTEX L6 ™ |
| 4 | CARBOPOL 801 ™ | IR-2 |
| 5 | MOWIOL 5698 ™ | IR-2 |
| 6 | Polyacrylamide | IR-2 |

CARBOPOL 801 is a trade name of Goodrich for polyacrylic acid.

MOWIOL 5698 is a trade name of Hoechst for 98% hydrolyzed polyvinyl acetate.

PRINTEX L6 is a trade name of Degussa for carbon black.

The plates were exposed on a CREO TRENDSETTER 3244 ™ (trade name of Creo for a plate setter) with an energy in the writing plane of 558 mJ/cm$^2$ at a speed of 45 m/min. The exposed areas could be removed by rubbing with a dry cotton pad, revealing the hydrophobic background.

The plates were printed on an AB-Dick 360 press, using Van Son rubberbase VS 2329 as ink and 2% Tame as fountain. The results are given in table 2

TABLE 2

| Example | Scumming | Ink Acceptance | Run Length |
|---|---|---|---|
| 1 | no scumming | good | >10 000 |
| 2 | no scumming | good | >10 000 |
| 3 | no scumming | good | >10 000 |
| 4 | no scumming | good | >1 000 |
| 5 | no scumming | good | >1 000 |
| 6 | no scumming | good | >1 000 |

An imaging element 7 is prepared in an identical way as imaging element 1 with the exception that the 152 g of a hydrolyzed 22% tetramethylorthosilicate emulsion in water was replaced by 152 g of water. It was exposed, developed and printed as example 1. There was no ablation of the exposed areas and the exposed areas could not be rubbed off. By printing the ink acceptance was very poor.

It is clear that plates 1 to 6, whereof the hydrophilic polymer in the top layer is crosslinked by hydrolyzed tetramethyl orthosilicate gave good results while plate 1, whereof the hydrophilic polymer in the top layer is not crosslinked, gave a very poor result. An imaging element 8 is prepared in an identical way as imaging element 1 with the exception that the 50 g of a dispersion containing 30% silica was replaced by 50 g of water. It was exposed, developed and printed as example 1. The ink acceptance was good and the run length was >10 000 but the plate showed a slight scumming. It is clear that the addition of silica to the top layer improves the scumming of the printing plate.

What is claimed is:

1. A heat-sensitive imaging element for providing a lithographic printing plate, comprising a lithographic base with a hydrophobic oleophilic surface and a top layer comprising a compound capable of converting light into heat and a hydrophilic polymer, characterized in that said hydrophilic polymer is crosslinked.

2. A heat-sensitive imaging element according to claim 1 wherein the lithographic base with a hydrophobic oleophilic surface is a plastic film.

3. A heat-sensitive imaging element according to claim 2 wherein said plastic film is a polyethylene terephthalate film.

4. A heat-sensitive imaging element according to claim 1 wherein said compound capable of converting light into heat is an infrared absorbing component.

5. A heat-sensitive imaging element according to claim 1 wherein the compound capable of converting light into heat is an infrared absorbing cyanine dye or carbon black.

6. A heat-sensitive imaging element according to claim 1 wherein said crosslinked hydrophilic polymer is crosslinked with hydrolyzed tetraalkyl orthosilicate.

7. A heat-sensitive imaging element according to claim 1 wherein said top layer comprises colloidal silica.

8. A heat-sensitive imaging element according to claim 1 wherein said top layer has a thickness of at least 0.5 $\mu$m.

9. A heat-sensitive imaging element according to claim 1 wherein between the top layer and the hydrophobic oleophilic surface of the support there is present at least one additional layer, said layer comprising at least one compound selected from the group of hydrophilic binders, silica and polymer latices.

10. A method for providing a lithographic printing plate comprising the steps of imagewise exposing a heat-sensitive imaging element according to claim 1 and developing said imagewise exposed imaging element either by dry rubbing the surface, removing at least partially the exposed surface either by wet rubbing the surface using water or an aqueous liquid, removing at least partially the exposed surface, or on-press removing at least partially the exposed surface by action of the fountain solution and/or the ink.

* * * * *